US005148782A

United States Patent [19]

Krämer et al.

[11] Patent Number: 5,148,782

[45] Date of Patent: Sep. 22, 1992

[54] CASING OF A TRUNK PISTON INTERNAL COMBUSTION ENGINE

[75] Inventors: Michael Krämer, Notzingen; Karl Zeilinger, Winnenden; Theodor Bacu, Waiblingen, all of Fed. Rep. of Germany

[73] Assignee: Mercedes-Benz AG, Fed. Rep. of Germany

[21] Appl. No.: 780,114

[22] Filed: Oct. 21, 1991

[30] Foreign Application Priority Data

Oct. 23, 1990 [DE] Fed. Rep. of Germany ..... 4033623

[51] Int. Cl.[5] ..... F02F 7/00

[52] U.S. Cl. ..... 123/195 R; 123/41.74; 29/888.01

[58] Field of Search ..... 123/41.72, 41.74, 193 C, 123/193 CH, 193 H, 195 R; 29/888.01, 888.06

[56] References Cited

U.S. PATENT DOCUMENTS 4,370,951 2/1983 Pomfret ..... 123/41.74

FOREIGN PATENT DOCUMENTS 6610188 6/1973 Fed. Rep. of Germany .
3829854 3/1990 Fed. Rep. of Germany .
63-131853 6/1988 Japan ..... 123/193 CH
147010 4/1921 United Kingdom ..... 123/41.72

*Primary Examiner*—Noah P. Kamen
*Attorney, Agent, or Firm*—Evenson, Wands, Edwards, Lenahan & McKeown

[57] ABSTRACT

A casing of a trunk piston internal combustion engine has a cylinder hed, cylinder head cover, cylinder block and oil sump regions and bearing devices for the crankshaft and camshaft. The casing is manufactured from parts which are as simple to manufacture as possible and can be connected together with little effort. For this purpose, the cylinder block, together with a part of the cylinder head closing the respective individual cylinder spaces at the combustion space end, is configured as a common engine block casting with hollow spaces manufactured without the use of lost cores and open in the direction of the cylinder axis at one of the two ends of at least. The hollow spaces are closed by parts welded onto both ends to create a closed continuous water cooling jacket.

14 Claims, 3 Drawing Sheets

CASING OF A TRUNK PISTON INTERNAL COMBUSTION ENGINE

BACKGROUND AND SUMMARY OF THE INVENTION

The present invention relates to a casing of a trunk piston internal combustion engine having a cylinder head, cylinder head cover block, oil sump regions and bearing devices for the crankshaft and camshaft.

In known casings, the cylinder block and crankcase are usually an integral part. It is also known to configure the cylinder head and cylinder block as an integral casting, with the cooling water spaces being formed by using soluble cores in the casting. The individual parts are bolted together to form a closed engine casing.

In addition, the welding together of individual separately manufactured parts of the engine casing is also already known, as shown in U.S. Pat. No. 2,975,778 and DE-GM 66 10 188. The structure of this known welded engine casing, however, is extremely complicated. The same problem applies, in principle, to the casing shown in U.S. Pat. No. 2,975,778 in which additional bolted connections are also necessary.

Accordingly, the present invention solves the problem of being able to manufacture the engine casing in a particularly low-cost manner from casings which can, overall, be assembled in as simple a manner as possible. In particular, complicated castings which can only be produced by the use of lost cores are now unnecessary.

This problem has been solved in accordance with the present invention by an engine casing in which the cylinder block region, together with a part of the cylinder head closing each of the individual cylinder spaces at the combustion space end, is a common engine block casting, which has open hollow spaces manufactured without the use of lost cores and is open in the direction of the cylinder axis without an undercut portion, at least at one end thereof. The hollow spaces are closed by parts welded onto both axial ends to create a closed continuous water jacket.

The material of the engine casing should, in particular, be a light metal, preferably aluminum, which is cast by a vacuum diecasting method.

BRIEF DESCRIPTION OF THE DRAWINGS

Other objects, advantages and novel features of the present invention will become apparent from the following detailed description of a presently contemplated embodiment of the invention when considered in conjunction with the accompanying drawings wherein.

DETAILED DESCRIPTION OF THE DRAWINGS

Figure 1:
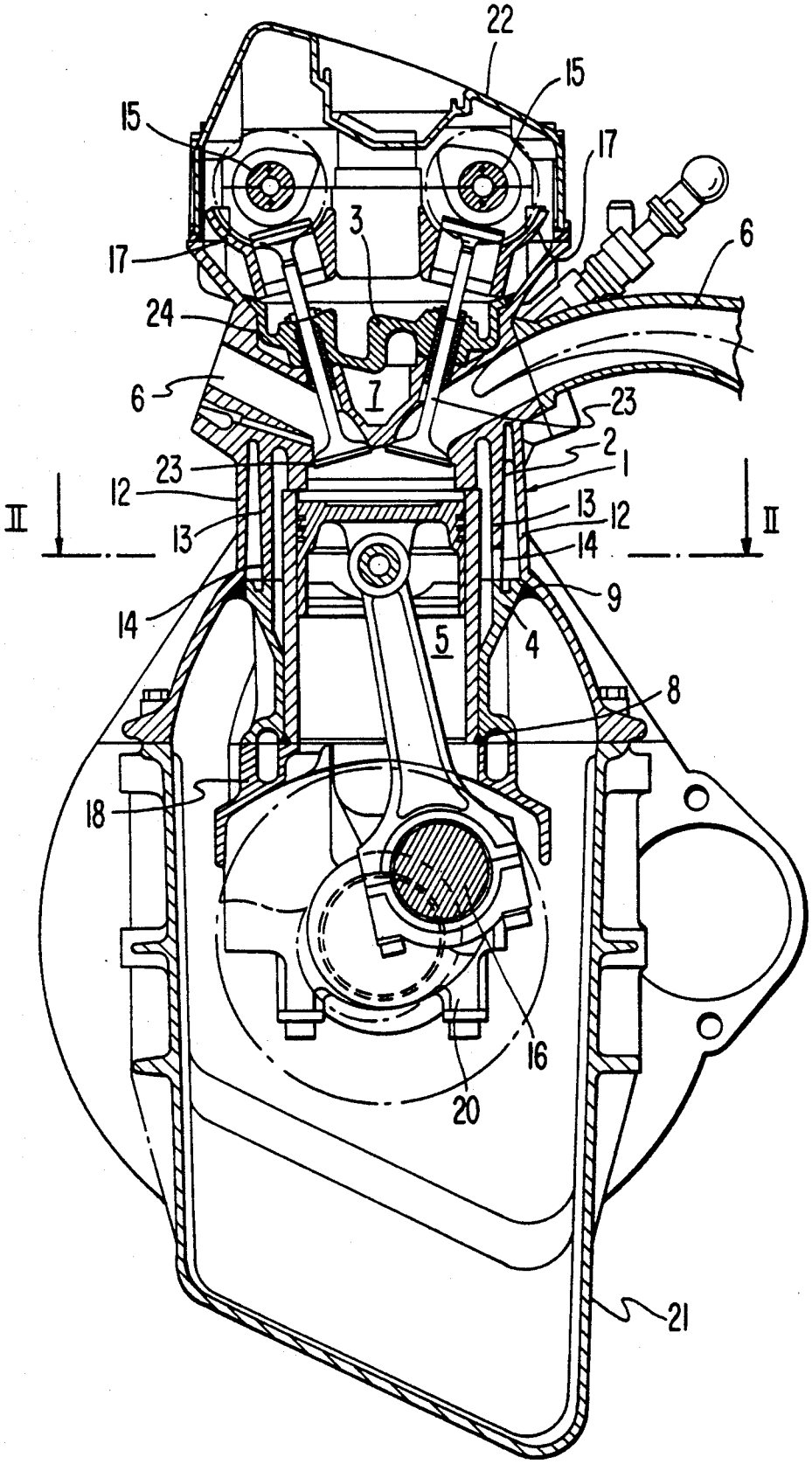
FIG. 1 is a cross-sectional elevational view through an engine with a step at the level of the upper ends of the cylinders.

The core of the engine casing is an engine block designated generally by the numeral 1 composed of a cast main part 2 and upper and lower closing parts 3 and 4, respectively, welded onto the upper and lower ends of the main part 2. The cylinder spaces 5, the inlet and outlet ducts 6, a spark plug holder (unnumbered) and the cooling water spaces 7 are located in the main part 2.

The main part 2 is made of an aluminum vacuum diecasting. The cooling spaces 7 are formed in the diecasting such that they can be manufactured by removable casting tools. The preformed cooling spaces are closed, on one hand, by the upper closing part 3, and, on the other hand, by the lower closing part 4, both of which parts are welded to the main part 2. The lower closing part 4 is welded by two separate welding seams 8 and 9, of which the welding seam 9 is located on the outer casing wall and the welding seam 8 is located on the inner cylinder wall at the bottom end of the cylinder.

Figure 2:
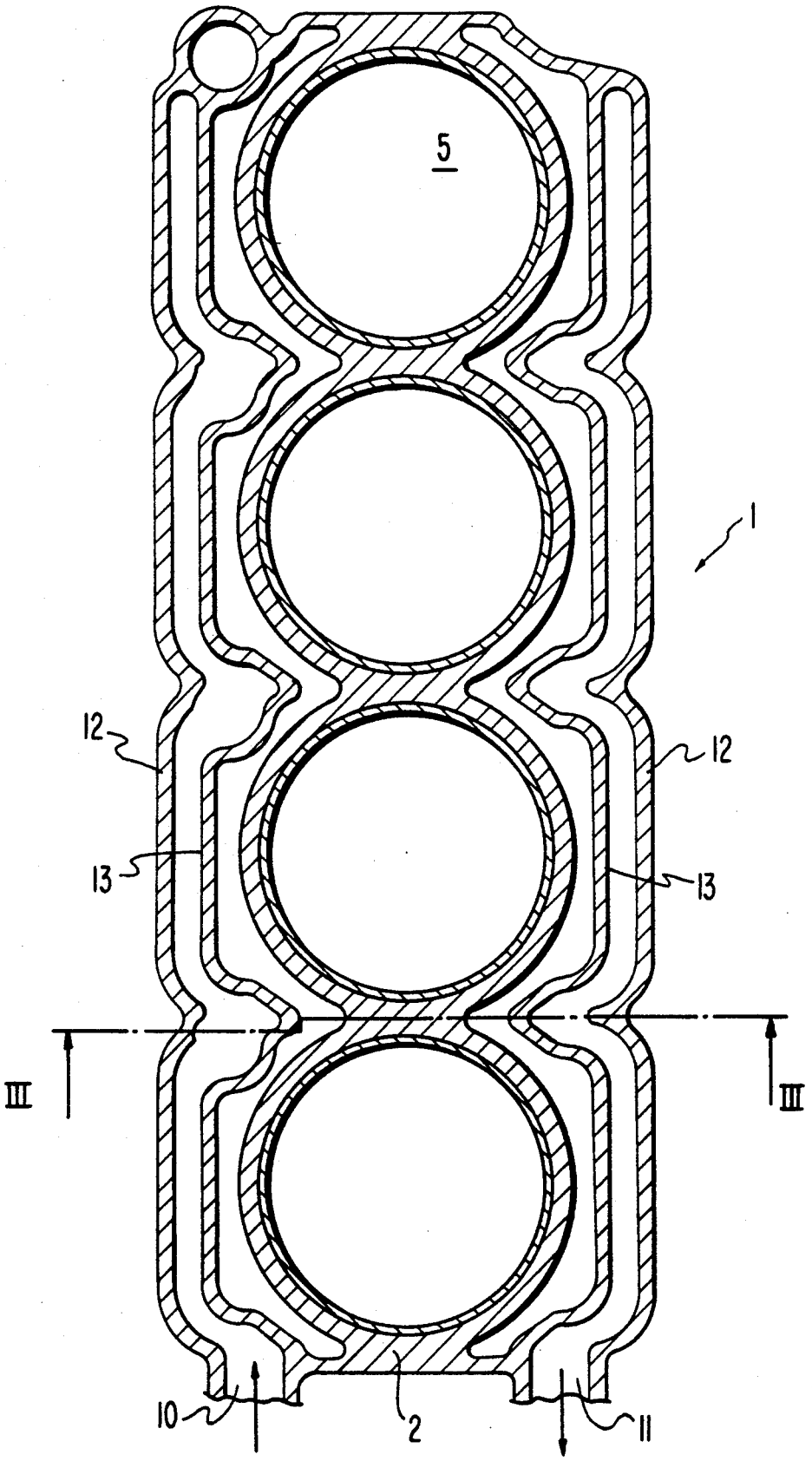
FIG. 2 is a sectional view along line II—II of FIG. 1.
Figure 3:
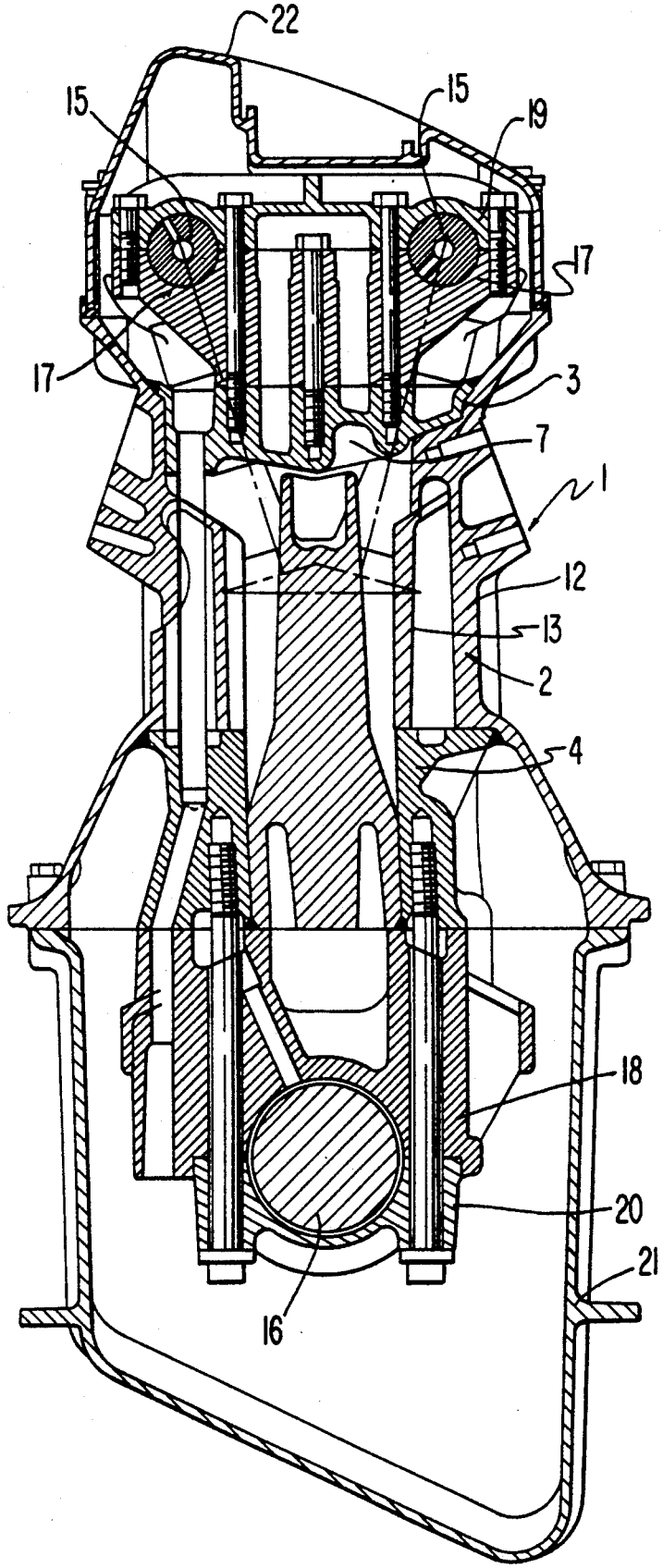
FIG. 3 is a sectional view along the line III—III in FIG. 2.

The cooling water flows around the individual cylinders in cross-flow so as to enter, as shown in FIG. 2, the engine casing at the inlet connection 10 and to leave the casing through the outlet connection 11. The cooling space walls 12, 13 extending continuously over the entire length of the engine are formed in the diecasting. The cooling space wall 13 has recesses 14 (FIG. 1) open towards the end of the cylinder, and these recesses permit cooling water cross-flow in the individual cylinders through the cylinder head.

Bearing devices for the camshafts 15 and the crankshaft 16 are bolted onto the respective upper closing part 3 and the lower closing part 4. The bearing devices each consist of a bearing block 17 and 18 configured as a through cover bridge and respective bearing covers 19 and 20 joining an associated through cover bridge. The engine casing is closed at the bottom by an oil sump 21 which is bolted to the main part 2 in a plane common with that of the lower end of the cylinders. The cylinder head is closed by a cylinder head cover 22 which is also bolted to the main part 2. The valve stems 23 are guided in guide bushes 24 which are located by a press fit at the same time within the upper closing parts 3 and the adjacent main part 2. The holes into which the guides bushes 24 are inserted are produced after the upper closing part 3 has already been welded on. The type of valve timing gear can be of any given type and is not limited to the disclosed embodiment.

The decoupling of the support for the camshaft and crankshaft from the outer engine casing regions leads, in a very advantageous manner, to a noise reduction from the engine gearing due to the lower engine casing noise radiation.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A casing of a trunk piston internal combustion engine having a cylinder head, cylinder head cover, cylinder block and oil sump regions with bearings for the crankshaft and camshaft, wherein the cylinder block region, together with a part of the cylinder head closing each of the individual cylinder spaces at the combustion space end, is a common engine block casting which has open hollow spaces manufactured without the use of lost cores and is open in the direction of a cylinder axis at at least one end without undercut, and closing parts welded onto axial ends of the casting to close the hollow spaces and provide a closed continuous water jacket.

2. The casing according to claim 1, wherein the two closing parts constitute, respectively, carriers for bearings of the camshafts, and of the crankshaft, and the bearings are respectively bolted onto these carriers.

3. The engine casing according to claim 1, wherein the respective bearings are each a through bearing block bridge with bearing covers mounted thereon.

4. The casing according to claim 3, wherein the closing parts constitute, respectively, carriers for bearings of the camshafts, and of the crankshaft, and the bearings are respectively bolted onto these carriers.

5. The casing according to claim 3, wherein the respective bearing block bridge and bearing cover are respectively bolted together by bolts so as to be fixed on the closing parts.

6. The casing according to claim 3, wherein a split plane between the cylinder block and the oil sump is located on the same level as a split plane between the bottom closing part at the crank space end and the crankshaft bearing block bridge.

7. The casing according to claim 1, wherein, with a plurality of in-line cylinders arranged one against the other and having cooling water flowing transversely therearound, on both sides of a plane including the cylinder axes, two cooling ducts respectively extend parallel to one another, of which the two ducts on both sides of the plane are respectively connected to the ducts adjacent to the cylinders in the cylinder head by a space covered by the local upper closing part, while each of the two ducts located on the outside relative to the plane are connected together with the respective inner ducts by precast recesses, in the duct separating walls, open towards the crank space end of the lower closing part.

8. The casing according to claim 1, wherein at least a portion of valve stem guide holes are located in the common engine block casting constituting an integrally case main part.

9. The casing according to claim 1, wherein the valve stem guide holes penetrate through the upper closing part and guide bushes protruding into the main part pressed into the holes.

10. The casing according to claim 1, wherein at least one of the casing parts is a vacuum diecasting.

11. The casing according to claim 10, wherein the main part and the closing parts are made of light metal.

12. The casing according to claim 11, wherein the light metal is aluminum.

13. A method for manufacturing a casing of a trunk piston internal combustion engine having a cylinder head, a cylinder head cover, cylinder block and oil sump regions with bearings for crankshaft and camshaft, comprising the steps of:

forming a cylinder block region as a common engine block casting with open hollow spaces constituting cylinder spaces manufactured without lost cores and open in the direction of a cylinder axis without undercut at least at one end;

closing individual cylinder spaces at a combustion space and with a portion of the cylinder head; and welding closing parts at both axial ends of the hollow spaces to form a closed continuous jacket.

14. The method according to claim 13, further comprising the steps of forming valve stem guide holes through the closing part at the upper axial end of the hollow spaces, and pressing guide bushes into the valve stem guide holes.

* * * * *